United States Patent [19]

Jaffe et al.

[11] 4,301,728

[45] * Nov. 24, 1981

[54] ROTARY PRINTING PRESS WITH A BUMPING MECHANISM

[75] Inventors: Erwin Jaffe; Harshad Matalia; William D. Rinehart; Frederick L. Warner, all of Easton, Pa.; Menashe Navi, New York, N.Y.; George Merker, Fair Lawn, N.J.

[73] Assignee: American Newspaper Publishers Association, Easton, Pa.

[ * ] Notice: The portion of the term of this patent subsequent to Sep. 22, 1998, has been disclaimed.

[21] Appl. No.: 120,584

[22] Filed: Feb. 11, 1980

[51] Int. Cl.[3] ..... B41F 5/08; B41F 5/24; B41F 13/28; B41F 13/40

[52] U.S. Cl. ..... 101/220; 101/247; 101/218; 101/350

[58] Field of Search ..... 101/217, 218, 179, 247, 101/180, 181, 182, 183, 184, 185, 220, 221, 222, 223, 136, 137, 138, 139, 140, 143, 144, 145, 350, 351

[56] References Cited

U.S. PATENT DOCUMENTS

| | | | |
|---|---|---|---|
| 1,107,843 | 8/1914 | Robertson | 101/218 |
| 1,119,861 | 12/1914 | Niles . | |
| 1,807,991 | 6/1931 | Lang et al. | 101/218 |
| 1,924,625 | 8/1933 | Roesen | 101/350 X |
| 2,055,319 | 9/1936 | Smith | 101/221 |
| 2,102,631 | 12/1937 | Lamatsch | 101/180 X |
| 2,256,514 | 9/1941 | Brueshaber | 101/350 |
| 2,278,312 | 3/1942 | Holtz | 101/218 |
| 2,874,636 | 2/1959 | Royer et al. | 101/218 |
| 3,030,884 | 4/1962 | Lindemann | 101/218 |
| 3,054,346 | 9/1962 | Koch et al. | 101/218 |
| 3,076,407 | 2/1963 | Zimmerman | 101/247 X |
| 3,329,086 | 7/1967 | Pullen | 101/218 X |
| 3,416,444 | 12/1968 | Cahn | 101/181 |
| 3,527,165 | 9/1970 | Harless | 101/143 |
| 3,630,146 | 12/1971 | Shields | 101/351 |
| 3,691,956 | 9/1972 | James et al. | 101/247 |
| 3,747,524 | 7/1973 | Crum | 101/365 |
| 3,817,174 | 6/1974 | Paulson | 101/218 |

*Primary Examiner*—J. Reed Fisher
*Attorney, Agent, or Firm*—David H. Semmes

[57] ABSTRACT

Rotary printing presses of the type embodying rotatably driven series of inking cylinder, plate cylinder and impression cylinder components. Particularly, a mechanism for "bumping" the impression cylinder shaft with respect to the plate cylinder for press adjustment or repair and web adjustment without dismantling of the press. The "bumping" mechanism includes eccentric bushing plates supporting the impression cylinder shaft at either end and a pivotally mounted bell crank with a follower strut pivotally secured to the bushing plate. As the bell crank is pivoted, the impression cylinder shaft is "bumped" or displaced with respect to the plate cylinder.

3 Claims, 5 Drawing Figures

ROTARY PRINTING PRESS WITH A BUMPING MECHANISM

CROSS-REFERENCES TO RELATED APPLICATIONS

The present application concerns a rotary printing press of the type disclosed in assignee's co-pending ON THE FLY ADJUSTING MECHANISM (Ser. No. 111,410), filed Jan. 11, 1980.

BACKGROUND OF THE INVENTION

1. Field of the Invention

Rotary printing presses, particularly the newspaper type, embodying abutting plate cylinder and impression cylinders. Particularly, a mechanism for bumping the impression cylinder shaft with respect to the plate cylinder, such that the web may be adjusted, repairs may be undertaken or the plates removed without closing down the press.

2. Description of the Prior Art

Being submitted separately in a Prior Art Statement under 37 C.F.R. 1.97.

SUMMARY OF THE INVENTION

The present invention is directed to a printing press having a "bumping" mechanism and other adjustment features, while eliminating a great number of conventional moving parts. The result is a lighter press, which requires a lesser capital investment and operates with a reduction in noise, a reduction in ink due to lesser over spray and a reduction in energy requirement due to lesser frictional engagement between moving parts. For example, it is estimated that the present press involving two rotatably driven, superposed series of plate cylinder, impression cylinder and inking cylinder components in a newspaper mode, may be driven with a twelve horsepower 900 rpm input so as to obtain a 450 rpm output. Conventionally driven presses of this capacity require 75 horsepower drive mechanisms. The saving in capital investment, printing ink and drive mechanism energy input are manifest.

DESCRIPTION OF THE PREFERRED EMBODIMENTS

Figure 1:
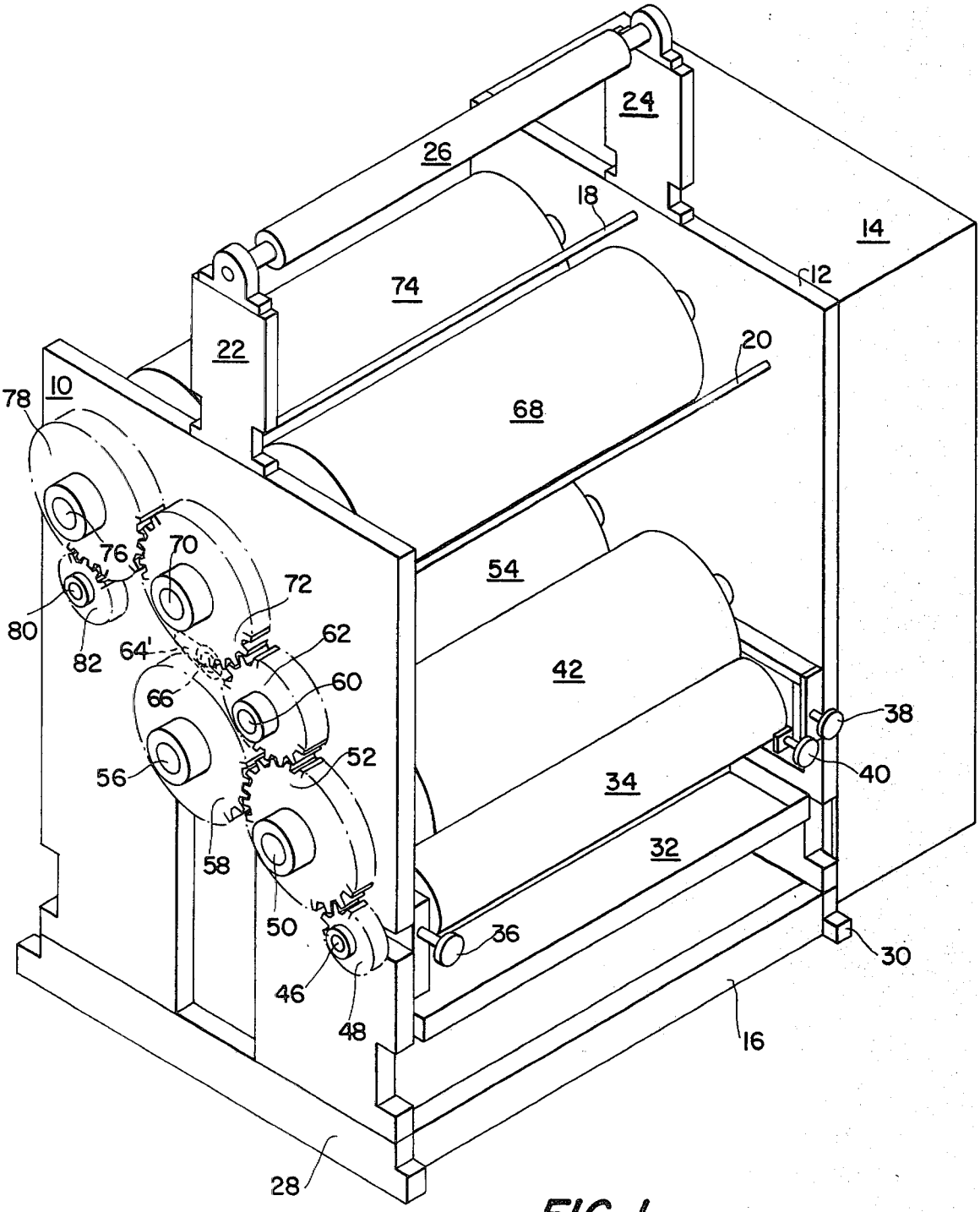
FIG. 1 is a perspective view from the operator's side of a newspaper printing press, constructed according to the present invention.

In FIG. 1 a rotary newspaper press is illustrated as comprising vertical side members or plates 10 and 12, drive side removable cover 14 and transverse end plate 16, extending between base support elements 28 and 30 at the bottom of the press. Side plates 10 and 12 may be rigidized, as illustrated in FIGS. 1, 2 and 3, by means of a plurality of transversely extending rods 18, 20, 140, 142, 144.

A rotatable web exit roller 26 may be positioned intermediate vertically extending brackets 22 and 24, mounted respectively upon side plates 10 and 12.

Figure 2:
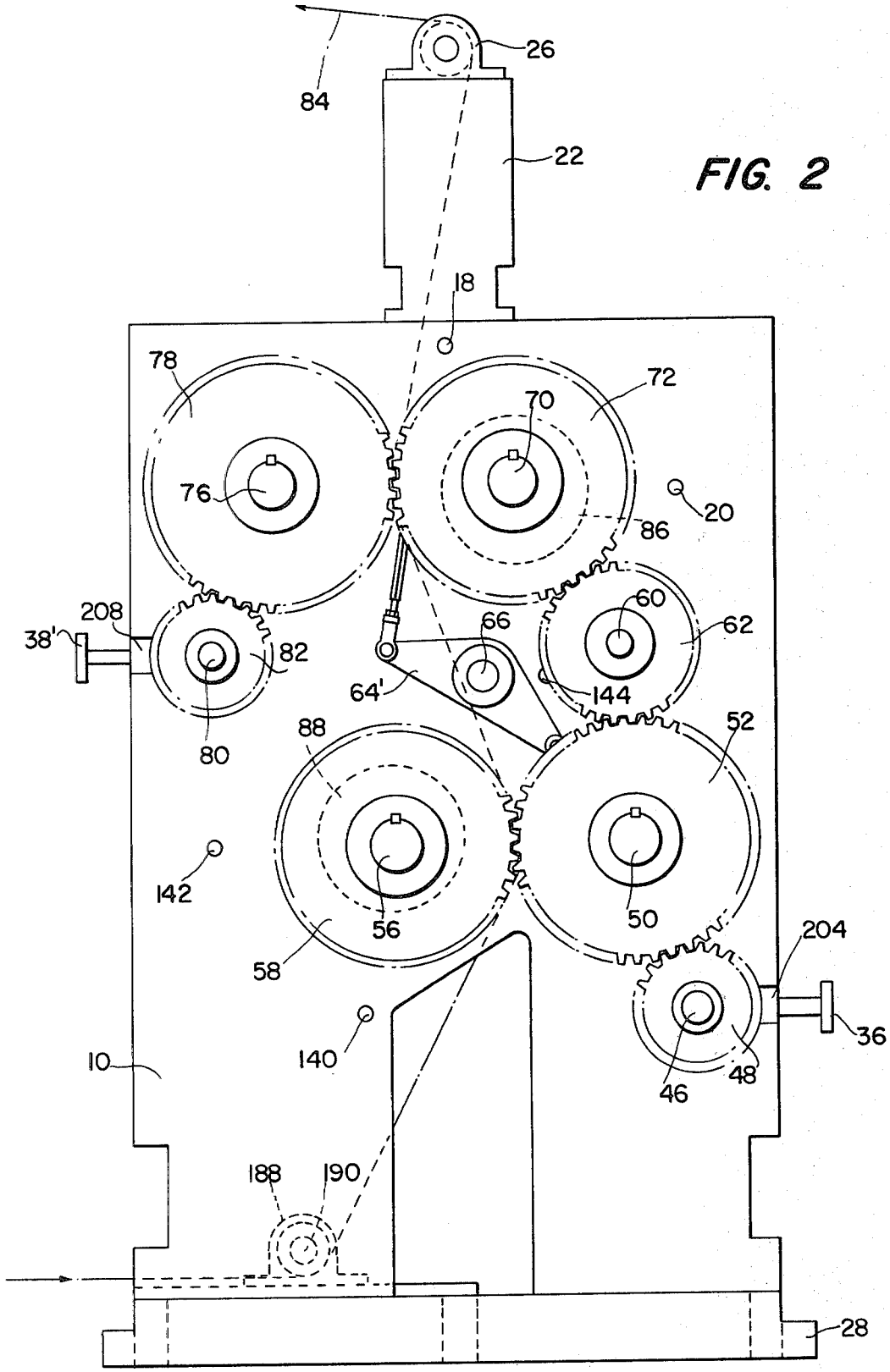
FIG. 2 is a side elevation from the operator's side.

As illustrated in the lower part of FIG. 2, a web entry roller 188 may be mounted upon shaft 190 extending intermediate the side plates 10 and 12, so as to introduce the advancing web 84 intermediate the first series plate cylinder 42 and impression cylinder 54.

Figure 3:
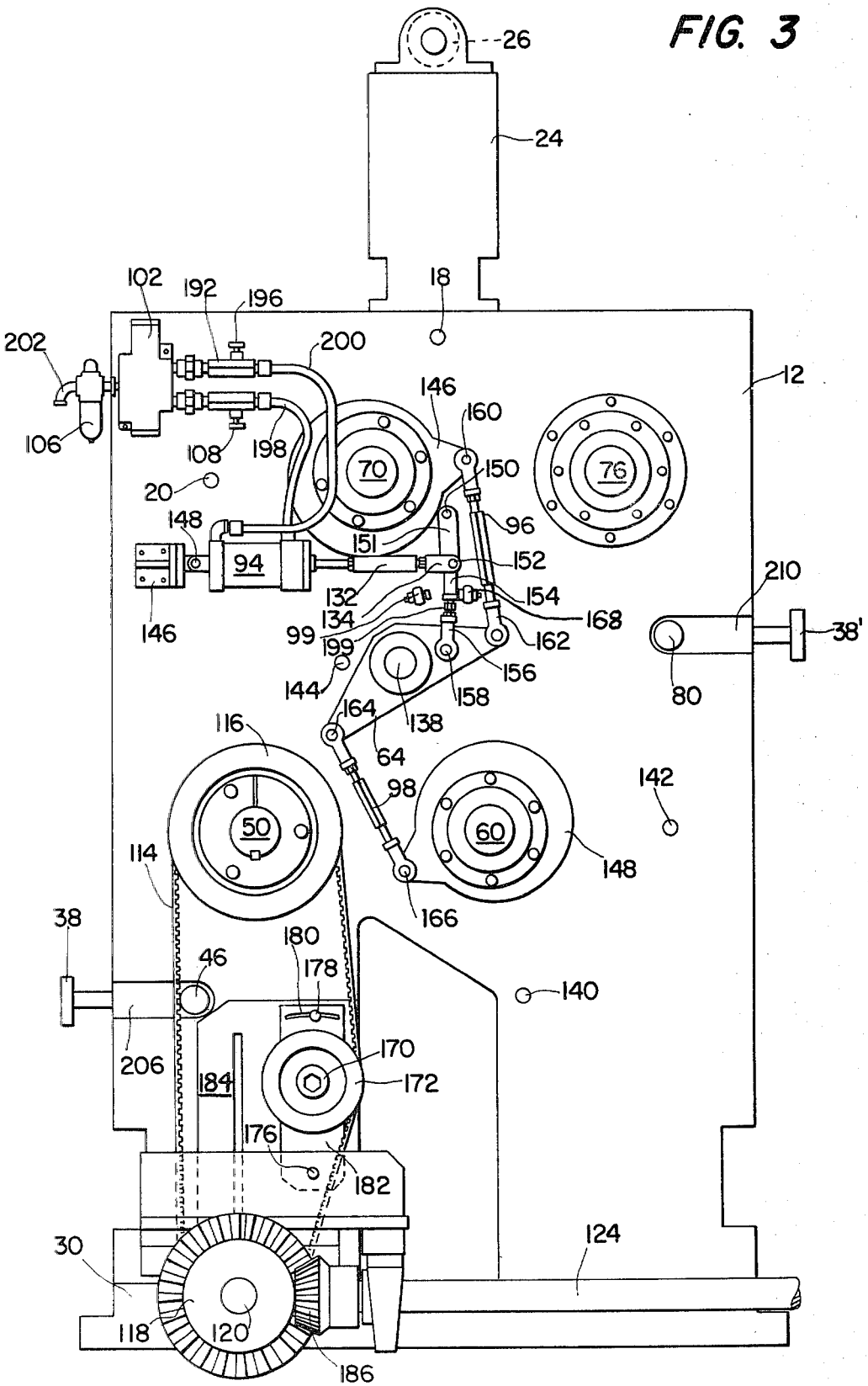
FIG. 3 is a drive side elevation.
Figure 4:
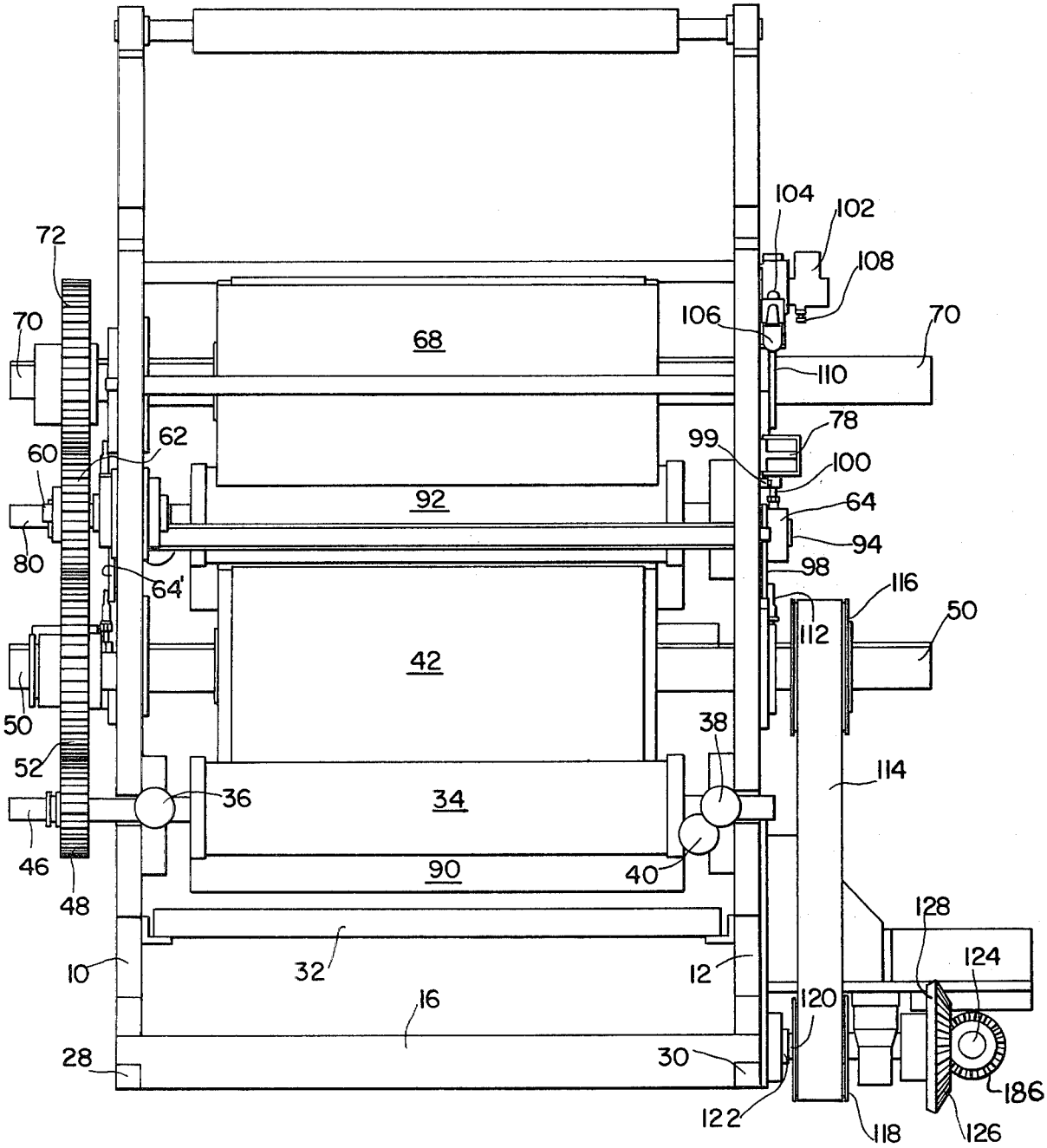
FIG. 4 is a front elevation of the press, showing the superposed inking cylinder and plate cylinder.
Figure 5:
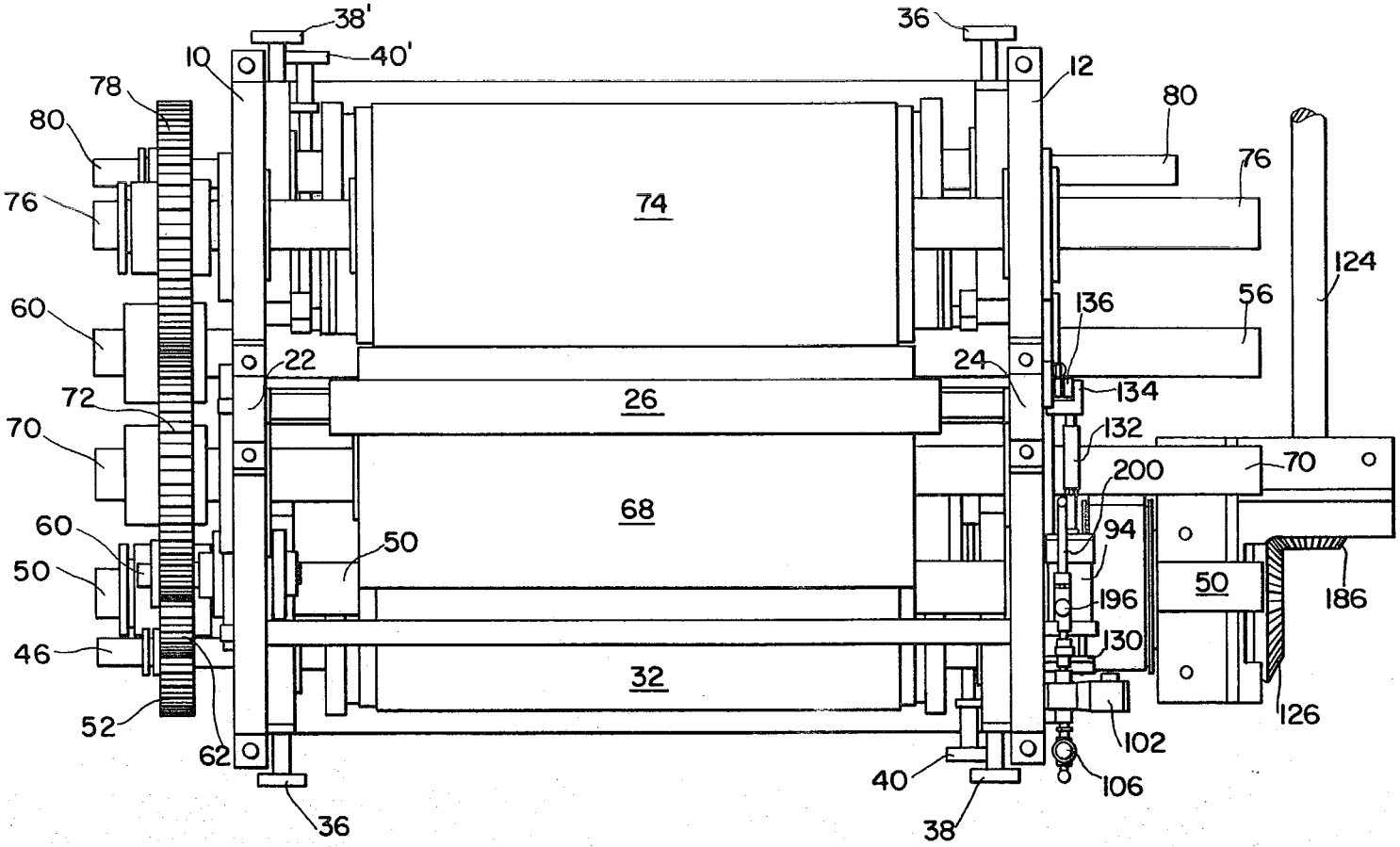
FIG. 5 is a top plan.

As illustrated in FIGS. 1–3, inking cylinder 34 may be rotatably mounted upon shaft 46 extending between side plates 10 and 12 and adjustably secured in the side plate adjusting slots 204, 206 by means of adjusting knobs 36 and 38. As illustrated in FIG. 4, a reverse angle doctor blade 90 may be adjustably positioned by means of doctor blade adjustment knob 40, so as to engage inking cylinder 34 above drip pan 32. Inking cylinder 34 may be of the engraved surface "Anilox" type having, for example, 220 to 350 ink repository cells per linear inch. Plate cylinder 42 may be mounted upon plate cylinder shaft 50, extending between side plates 10 and 12. Spur gear 52, on the operator's side of the press engages inking cylinder spur gear 48. On the drive side of the press the timing belt pulley 116 engages timing drive or cog belt 114. On the drive side, as illustrated in FIG. 3, timing belt pulley 116 may be driven by drive belt 114 extending about timing belt pulley 118, secured to shaft 120 extending outboard of side plate 12. Timing belt pulley 118, on shaft 120 with bevel gear 128 in turn, may engage bevel gear 186 mounted upon drive shaft 124.

Every other spur gear may be of the plastic type, boiled suitably in water prior to use, such that the tendency to absorb oil will be reduced. The use of plastic gears will reduce the noise.

Belt 114 may be tightened or adjusted by means of idler pulley 172 mounted upon shaft 170 seated in adjustment plate 182. As illustrated in FIG. 3, plate 182 is pivoted as at 176 to drive plate 184, fitted to side plate 12. Plate 182 may include adjusting slot 180 and hold down screw feature 178.

The impression cylinder 54 may be mounted upon transverse shaft 56 seated at either end in eccentric bushing plates 88 and 148. On the operator's side impression cylinder spur gear 58 is contactable with plate cylinder spur gear 52. An idler spur gear 62 may be mounted upon short shaft 60 secured in side plate 10, so as to engage the corresponding impression cylinder 68 spur gear 72, secured to transverse shaft 70. In the upper rear of FIG. 1 there is illustrated plate cylinder 74 secured upon transverse shaft 76 having on the operator's side spur gear 78 engageable with the corresponding spur gear 72 of impression cylinder 68. Spur gear 78 in turn engages spur drive gear 82, secured to the inking cylinder shaft 80.

As illustrated in FIGS. 2 and 3, upper impression cylinder 68 is mounted upon shaft 70 which is seated at either end in eccentric bushing plates 86 and 146. The upper inking cylinder 92 may be adjustably secured with respect to plate cylinder 74 by means of knurled adjustment knob 38 engaging inking cylinder shaft 80 which is supported by frame mounted tracks in clearance slots 208 and 210. Bell cranks 64 and 64' are keyed to a transverse shaft 66 for pivotal movement as at 138 in side plate 12 and as at 66 in side plate 10.

As illustrated in FIG. 3, a vertically adjustable follower strut 96, is pivotally secured at one end to the bell crank 64 end as at 162 and at its other end strut 96 is pivotally secured as at 160 to impression cylinder eccentric bushing plate 146. Corresponding follower strut 98 is pivotally mounted as at 164 to the other end of bell crank 64 and to impression cylinder eccentric plate 148 as at 166. An articulated link 154 may be pivotally secured at one end 150 to side plate 12 and at its other adjusting end 156 to bell crank 64 as at 158. The mid or articulated portion 152 is secured to clevis 134 attached to piston shaft 132. A piston assembly 94 may be pivotally mounted as at 148 to bracket 146 and may be driven by air supplied by electrically controlled valve 102 having air entry conduit 202, lubricator 106, and pressure adjusting valve 108 and exit tube 198.

One or more limit stops 99 and 168 may be secured to plate 12 on either side of articulated link 154, so as to limit articulation of the link and, thus, pivoting of bell crank 64 and eccentric bushing plates 146, 148. Manifestly, articulated link bottom portion 158 may be longitudinally adjusted by turnbuckler 199. Similarly, piston shaft 132 may be longitudinally adjusted with respect to clevis assembly 134.

As will be apparent, the press may be "bumped" simply by actuating piston 94 and shaft 132 to pivot the bell cranks 64 and 64', secured to the transverse shaft 138. Correspondingly, the follower struts 96 and 98 pivot eccentric bushing plates 146 and 148 to "bump" the impression cylinder shafts 60 and 70 with respect to the corresponding plate cylinders 52 and 74. As a result, minor press adjustments may be made, the plates removed or adjusted and the web reunited.

Manifestly, various types of bell crank mechanisms may be employed without departing from the spirit of invention.

We claim:

1. A rotary printing press of the type wherein the web is advanced through a superposed first series and second series of rotatably driven inking cylinder, plate cylinder and impression cylinder components comprising:

A. A frame including first and second side plates rigidized with respect to each other;

B. Said first series and second series, each including:

i. an inking cylinder rotatably mounted between said side plates;

ii. a plate cylinder rotatably mounted between said side plates in juxtaposition with said inking cylinder and operatively connected to a rotatable drive; and iii. an impression cylinder rotatably mounted upon an impression cylinder shaft extending between said side plates, each end of said impression cylinder shaft being fitted within an eccentric bushing, said impression cylinder being engagable with a web being advanced intermediate said plate cylinder and said impression cylinder; said first series plate cylinder being mounted upon a plate cylinder shaft extending between said side plates and including a press rotary drive mechanism, engaging said plate cylinder shaft at one end in said first side plate and a spur gear supported upon said plate cylinder shaft at its other end in said second side plate, so as to be engagable with a corresponding spur gear mounted upon the impression cylinder shaft and in said second side plate; and C. A flexible timing belt extending from said press rotary drive mechanism to said first series plate cylinder shaft and an adjustable pulley member engagable with said timing belt; and D. A bumping mechanism engagable with said impression cylinder shaft eccentric bushing in said first series and said second series and further including:

i. a bell crank pivoted to each of said side plates and mounted upon a bell crank shaft extending between said side plates;

ii. vertically adjustable follower struts extending from each said bell crank to said impression cylinder eccentric bushings on both said side plates, each follower strut being adjustably extensible to a pivotal connection with each said impression cylinder eccentric bushing;

iii. pivot means secured to said first side plate and pivotally engaging said bell crank, so as to pivot said bell crank and said eccentric bushings and, thereby, "bump" said impression cylinder shafts with respect to said plate cylinders, said pivot means further including:

(a) a vertically adjustable actuated link pivoted upon said first side plate at one end and pivotally engaging said bell crank at its other end, a midportion of said link engaged by said pivot means, so as to pivot said articulated link and said bell cranks into a bumping mode; and (b) a longitudinally adjustable drive piston mounted upon said first side plate and having a longitudinally extensible shaft engaging said link, so as to pivot said bell cranks into a bumping mode.

2. A rotary printing press as in claim 1, including adjustable stops positioned upon said first side plate on either side of said articulated link so as to limit movement of said link and said bell crank.

3. A rotary printing press as in claim 1, wherein said flexible timing belt is of the cog type.

* * * * *